United States Patent [19]

Chen

[11] Patent Number: 5,035,419

[45] Date of Patent: Jul. 30, 1991

[54] EXERCISING MECHANISM HAVING A SELECTIVE COUPLING ASSEMBLY

[76] Inventor: Yi-Shun Chen, No. 36, Alley 23, Lane 493, Sec., 3, Chung Shan Rd., Tan Tzu Hsiang, Taichung Hsien, Taiwan

[21] Appl. No.: 583,546

[22] Filed: Sep. 17, 1990

[51] Int. Cl.[5] ..... A63B 23/04

[52] U.S. Cl. ..... 272/73

[58] Field of Search ..... 272/73, 71, 72, 130; 128/25 R

[56] References Cited

U.S. PATENT DOCUMENTS 4,586,706 5/1986 Chen ..... 272/73

4,844,451 7/1989 Bersonnet et al. ..... 272/73

4,962,925 10/1990 Chang ..... 272/73

*Primary Examiner*—Stephen R. Crow

*Attorney, Agent, or Firm*—Townsend and Townsend

[57] ABSTRACT

An exerciser has a handlebar pivoted to a frame and a drive axle and a shaft supported between two plates. A drive gear is fixed on the drive axle. Two rings are rotatably provided on the shaft and are engagable with each other. A driven gear is provided on one of the rings. When the drive gear and the driven gear are engaged with each other, the lower end of the handlebar is driven to swing by a rotation of a cam which is fixed to the other ring so that the handlebar can optionally be caused to swing.

2 Claims, 4 Drawing Sheets

EXERCISING MECHANISM HAVING A SELECTIVE COUPLING ASSEMBLY

BACKGROUND OF THE INVENTION

The present invention relates to an exercising mechanism, and more particularly to an exercising mechanism having a selective coupling assembly for selectively coupling the handle portion thereof.

Ordinary cycle exercisers are in the nature of a stationary, one-wheel cycle, with a pedal-driven apparatus applying work to a resistance wheel of some kind. In recent years, the cycle exercisers include elongated levers with handgrips. The elongated levers can pivot about the wheel axle and are connected to a crank ring which causes rotation of the energy absorbing wheel.

Several examples of such a cycle exerciser are disclosed in U.S. Pat. No. 4,188,030 to Hooper, U.S. Pat. No. 4,657,244 to Ross, U.S. Pat. No. 4,712,789 to Brilando, U.S. Pat. No. 4,712,790 to Szymski, and U.S. Pat. No. 4,838,544 to Sasakawa. All the lever arms of the above-mentioned patents are directly coupled to the crank ring or the like so that the lever arms should be rotated in concert with the wheel axle. This is not optional when the users would like to have the exercise for only the muscles of the legs and the lower torso.

The present invention has arisen to mitigate and/or obviate the afore-described disadvantages of the conventional cycle exerciser.

SUMMARY OF THE INVENTION

The primary objective of the present invention is to provide an exercising mechanism which has a selective coupling assembly for selectively coupling a handle portion of the exercising mechanism so that the handlebar can optionally be caused to swing.

In accordance with one aspect of the invention, there is provided an exercising mechanism which includes a seat post, a handlebar pivoted to a front end of a frame, a main drive axle which is rotatably supported between a pair of plates of the frame, and a sprocket fixed at one end of the main drive axle for driving a chain. A drive gear is fixed on the main drive axle. A shaft is supported between the plates. Two rings are rotatably provided on the shaft and are engagable with each other. A driven gear is provided on one of the rings and is engagable with the drive gear. The lower end of the handlebar is driven to swing by a rotation of a cam which is fixed to the other ring. A block is caused to move up and down by a handle whose lower end is pivoted to the frame. The block has a tapered lower end. A guide is slidably supported on the frame and has a tapered surface for engagement with the tapered lower end of the block. When the block moves downward, the guide is caused to push one ring away from the other ring so that the drive gear and the driven gear are separated. When the block moves upward, the guide is released so that the drive gear and the driven gear are engaged with each other and so that the handlebar is caused to swing by a rotation of the cam.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
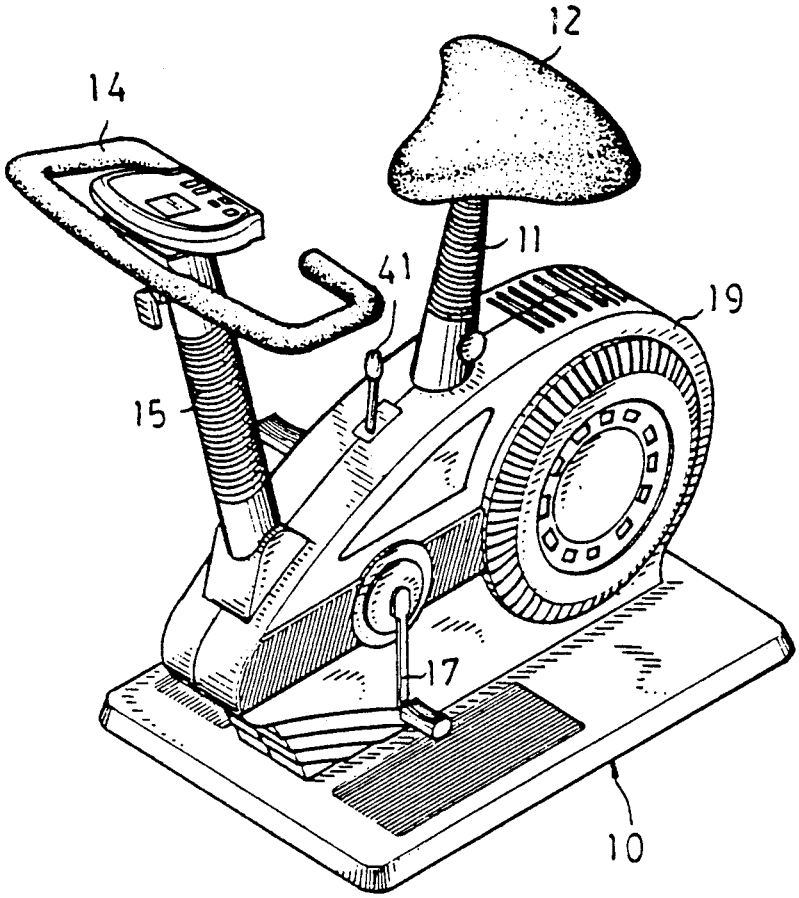
FIG. 1 is a perspective view of an exercising mechanism.
Figure 2:
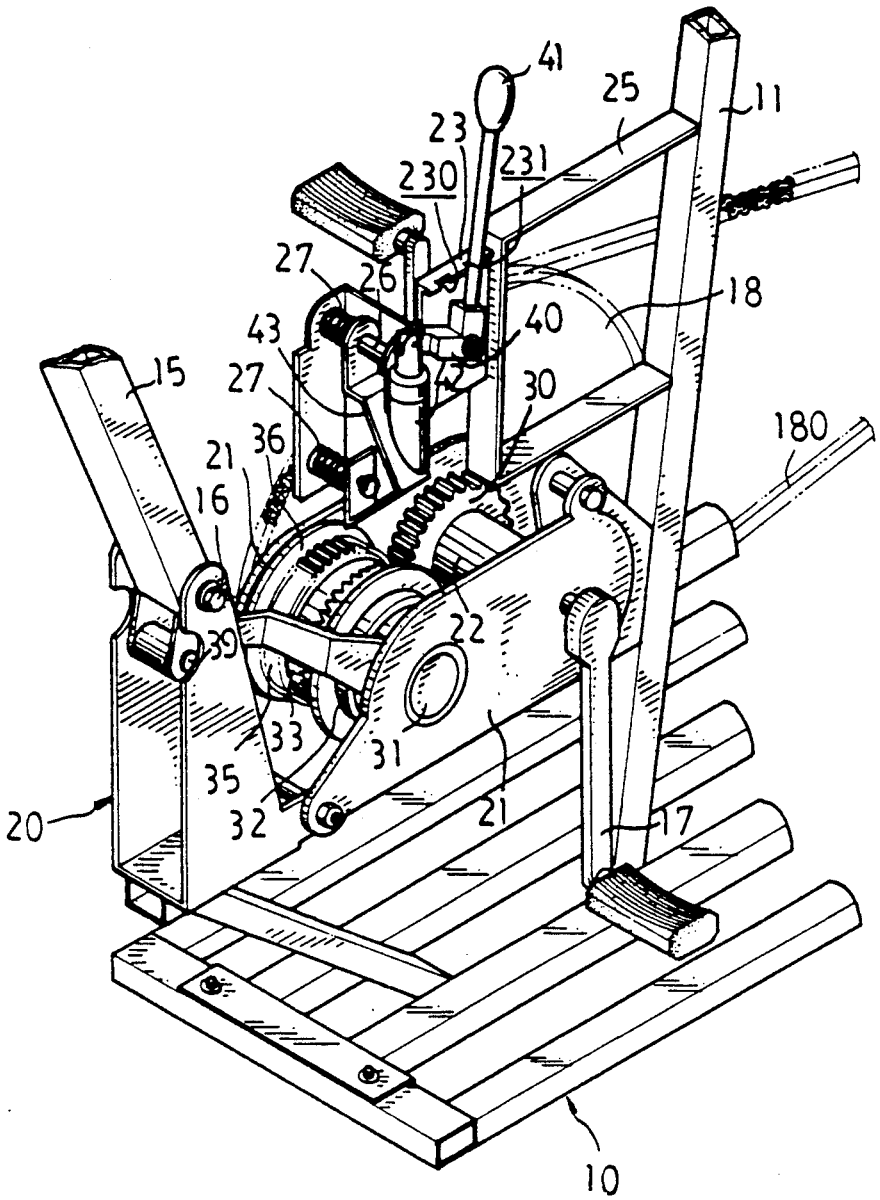
FIG. 2 is a partial perspective view of an exercising mechanism having a selective coupling assembly in accordance with the present invention.

Referring to the drawings and initially to FIGS. 1 and 2, illustrated is an exercising mechanism which employs a selective coupling assembly. The exercising mechanism comprises generally a base 10, a saddle 12 fixed to the base 10 by a seat post 11, a handle portion 14 fixed on an upper end of a handlebar 15 which is pivoted to a front end of a frame body 20 by a pivot axle 16, a pair of pedal crank arms 17 at opposite ends of a main drive axle 22 which is rotatably supported between a pair of frame plates 21 of the frame body 20, a sprocket 18 fixed at one end of the main drive axle 22, a chain 180 passed over the sprocket 18 for driving an energy-absorbing wheel or flywheel (not shown) and a casing 19 provided to enclosing the frame body 20 in order to prevent the user of the exercise bicycle from getting dirty or getting his clothes or body caught in the chains.

Figure 3:
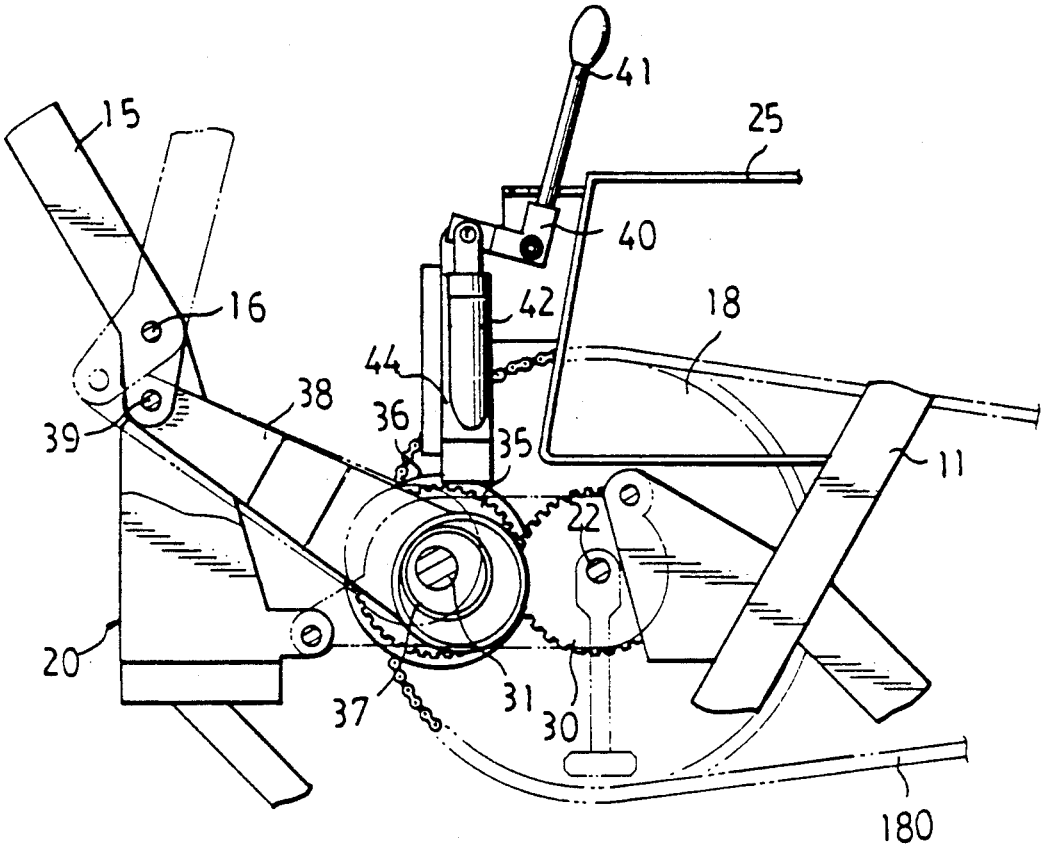
FIG. 3 is a side elevational view of the selective coupling assembly.

Referring next to FIGS. 3, 4 and again to FIG. 2, the selective coupling assembly comprises a drive gear 30 integrally fixed on the main drive axle 22 so that the drive gear 30 and the main drive axle 22 rotate in concert. A shaft 31 is supported between the frame plates 21 in parallel to the main drive axle 22. Two ring elements 32, 33 are rotatably provided on the shaft 31. Each of the ring elements 32, 33 has a circular rack 320, 330 facing each other. A spring 34 biases the ring element 33 toward the ring element 32 so that the racks 320, 330 thereof are engagable with each other. A driven gear 35 is provided on the ring element 33 and is caused to engage with the drive gear 30 when the ring element 33 is caused to engage with the ring element 32. A circular plate 36 which has a diameter lager than that of the ring element 33 is fixed to one side of the ring element 33 opposite to the rack 330. A cam 37 is integrally fixed to the ring element 32. The cam 37 is substantially a circular plate, but it is eccentric relative to the shaft 31 so as to act as a cam. One end of a link 38 is rotatably coupled over the cam 37, and the other end thereof is pivotedly connected to the lower end of the handlebar 15 at a pivot axle 39 so that the handlebar 15 can be caused to swing by a rotation of the cam 37 via the link 38.

The frame body 20 further includes an intermediate plate 23 fixed to the seat post 11 by a frame structure 25, and a supporting plate 24 perpendicularly fixed to the free end of the intermediate plate 23. An L-shaped lever 40 is pivoted on the intermediate plate 23. A handle 41 is fixed to one end of the lever 40, and a block 42 is pivoted to the other end of the lever 40. The block 42 can be caused to move up and down by the handle 41. Two notches 230, 231 are formed in the upper end of the intermediate plate 23 and are arranged so that the handle 41 can be engaged in either of the notches 230, 231. The lower end of the block 42 is tapered. The upper end and the lower end of a guide 43 are slidably supported on two pins 26 which are laterally fixed on the supporting plate 24. A tapered surface 44 is formed at the middle portion of the guide 43 for engagement with the tapered lower end of the block 42. A spring 27 is provided around each pin 26 between the guide 43 and the supporting plate 24 so as to bias the guide 43 toward the block 42.

Figure 4:
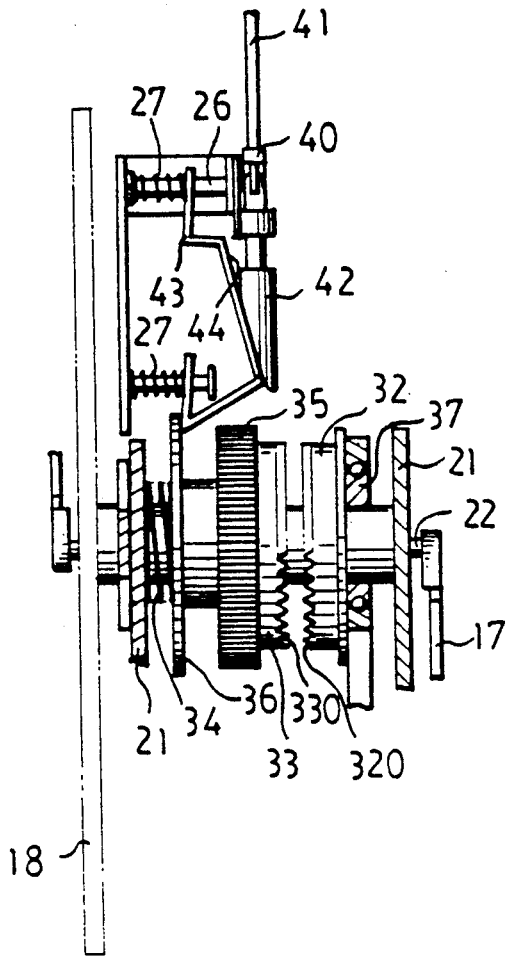
FIG. 4 is a front elevational view of the selective coupling assembly.

When the handle 41 is moved forward to engage within the notch 230 in order to cause the block 42 to move downward, as shown in FIG. 4, the guide 43 is pushed leftward by the engagement between the tapered surfaces of the block 42 and the guide 43 so that the circular plate 36 and thus the ring element 33 are pushed leftward against the bias of the spring 34 by an engagement between the lower end of the guide 43 and the circular plate 36. At this moment, the gears 30 and 35 are separated, and the ring elements 32 and 33 are also separated so that the handlebar 15 will not be caused to swing by a rotation of the main drive axle 22.

Referring again to FIG. 2, the block 42 is caused to move upward when the handle 41 is moved rearward to engage within the notch 231. At this moment, the guide 43 is biased toward the block 42, and the ring element 33 is biased toward the ring element 32 by the spring 34 so that the gears 35 and 30 are engaged with each other and so that the racks 320 and 330 of the ring elements 32, 33 are engaged with each other. The ring elements 32, 33 are rotated by an engagement between the gears 35 and 30, and the handlebar 15 is caused to swing by a rotation of the cam 37, best shown in FIG. 3.

Accordingly, the exercising mechanism having a selective coupling assembly in accordance with the present invention can selectively couple the handlebar of the exercising mechanism so that the handlebar can optionally be caused to swing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising mechanism comprising a base, a saddle fixed to said base by a seat post, a handle portion fixed on an upper end of a handlebar which has a lower portion pivoted to a front end of a frame body, a pair of pedal crank arms at opposite ends of a main drive axle which is rotatably supported between a pair of frame plates of said frame body, a sprocket fixed at one end of said main drive axle for driving a chain which passes over said sprocket; a drive gear integrally fixed on said main drive axle, a shaft supported between said frame plates, two ring elements including a first ring element and a second ring element being rotatably provided on said shaft, each of said ring elements having a circular rack formed on one side thereof, said circular racks facing each other, a first spring provided between one of said frame plates and said second ring element for biasing said second ring element toward said first ring element so that said circular racks of said ring elements are engagable with each other; a driven gear being provided on said second ring element and being caused to engage with said drive gear when said circular racks of said ring elements are engaged with each other; a cam integrally fixed to said first ring element, one end of a link being rotatably coupled over said cam, and another end of said link being pivotedly connected to a lower end of said handlebar so that said handlebar can be caused to swing by a rotation of said cam via said link; said frame body further including an intermediate plate fixed to said seat post by a frame structure, a supporting plate fixed to a free end of said intermediate plate, a lever pivoted on said intermediate plate, a handle fixed to one end of said lever, a block pivoted to another end of said lever, said block being caused to move up and down by said handle, two notches being formed in said intermediate plate and being arranged so that said handle can be engaged in either of said notches, said block having a tapered lower end; a guide being slidably supported on said supporting plate and having a tapered surface formed thereon for engagement with said tapered lower end of said block, a second spring being provided to bias said guide toward said block so that said tapered lower end of said block is engagable with said tapered surface of said guide; when said handle is moved to engage within one of said notches in order to cause said block to move downward, said guide being caused to push said second ring element away from said first ring element by an engagement between said tapered surface of said block and said tapered lower end of said guide so that said drive gear and said driven gear are separated, and so that said handlebar will not be caused to swing by a rotation of said main drive axle; when said handle is moved to engage within another of said notches, said block being caused to move upward, said guide being biased toward said block by said second spring, said second ring element being biased toward said first ring element by said first spring so that said drive gear and said driven gear are engaged with each other and so that said handlebar is caused to swing by a rotation of said cam.

2. An exercising mechanism according to claim 1, wherein a circular plate which has a diameter lager than that of said second ring element is fixed to one end of said second ring element opposite to said circular rack thereof, an upper end and a lower end of said guide are slidably supported on two pins which are laterally fixed on said supporting plate, said tapered surface is formed at a middle portion of said guide for engagement with said tapered lower end of said block, said second spring is provided between said supporting plate and said guide so as to bias said guide toward said block so that said tapered lower end of said block is engagable with said tapered surface of said guide; and said second ring element is caused to be separated from said first ring element by an engagement between a lower end of said guide and said circular plate.

* * * * *